United States Patent [19]

Haga et al.

[11] Patent Number: 5,046,933

[45] Date of Patent: Sep. 10, 1991

[54] VANE PUMP WITH PRESSURE LEAKING GROOVE TO REDUCE PULSATIONS

[75] Inventors: Kyosuke Haga, Anjo; Tsuneo Tanaka, Okazaki; Makoto Kawahara, Okazaki; Tatsuya Yamamoto, Okazaki, all of Japan

[73] Assignee: Toyoda Koki Kabushiki Kaisha, Kariya, Japan

[21] Appl. No.: 450,081

[22] Filed: Dec. 13, 1989

[30] Foreign Application Priority Data

Dec. 21, 1988 [JP] Japan ..... 63-320412
Sep. 26, 1989 [JP] Japan ..... 1-249887

[51] Int. Cl.[5] ..... F04C 2/344

[52] U.S. Cl. ..... 418/78; 418/133; 418/180

[58] Field of Search ..... 418/75, 78, 79, 180, 418/133

[56] References Cited

U.S. PATENT DOCUMENTS 4,060,343 11/1977 Newton ..... 418/78
4,256,443 3/1981 Kunze et al. ..... 418/78
4,470,768 9/1984 Konz ..... 418/133
4,557,678 12/1985 Nishimura ..... 418/180

FOREIGN PATENT DOCUMENTS 0265774 5/1988 European Pat. Off. .
0279166 8/1988 European Pat. Off. .
405613 11/1909 France .

*Primary Examiner*—John J. Vrablik
*Attorney, Agent, or Firm*—Oblon, Spivak, McClelland, Maier & Neustadt

[57] ABSTRACT

In a vane pump, a pump housing assembly contains a cam ring having an internal cam surface. A rotor carrying plural vanes is disposed within the cam ring and rotated by a drive shaft. Both end surfaces of the cam ring contact with a pair of flat contact surfaces formed within the pump housing assembly, respectively, and the vanes define plural pump sectors between the rotor and the cam ring, together with the rotor, the cam ring and the pair of contact surfaces. The contact surfaces are formed with a pair of intake ports and a pair of exhaust ports. Furthermore, one of the contact surfaces is provided with a pair of pressure leaking grooves formed at locations between the intake ports and the exhaust ports. The locations of the pressure leaking grooves are chosen so as to leak fluid in pump sectors communicating with the exhaust ports to adjacent pump sectors communicating with the intake ports through passages formed by the pressure leaking grooves and the side edges of vanes located between the two pump sectors whenever the instantaneous pressure of the fluid in the exhaust ports approaches an instantaneous maximum pressure. With this operation, the instantaneous maximum pressure is decreased, thereby the amplitude of the pressure pulsation being reduced.

6 Claims, 13 Drawing Sheets

VANE PUMP WITH PRESSURE LEAKING GROOVE TO REDUCE PULSATIONS

BACKGROUND OF THE INVENTION

1. Field of the Invention

The present invention relates to a vane pump suitable for use in a power steering system.

2. Description of the Prior Art

Conventionally is known a vane pump wherein a rotor having plural vanes is rotated within a cam ring received within a pump housing. In such vane pump, the vanes are supported slidably in radial directions so as to contact with an internal cam surface of the cam ring, so that plural pump sectors are defined between the rotor and the cam ring. When the rotor is rotated, volume of each pump sector changes in accordance with the cam curve of the internal cam surface so as to intake fluid from intake ports and to discharge pressurized fluid to exhaust ports.

The pressure of the fluid discharged from such pump pulsates due to the shape of the internal cam surface and leakage amount of the fluid from the pump sectors. To reduce such pressure pulsation of the discharged fluid, it has been tried to modify the curve of the internal cam surface. Although the pressure pulsation of the discharged fluid can be reduced by the modification of the cam curve, it was difficult to reduce the pressure pulsation to a required value. The pressure pulsation of the discharged fluid causes the pump and connection pipes connected to the pump to generate vibrations and noises. There is a power steering system wherein an accumulator is provided in order to absorb the pressure pulsation. However, such system has disadvantages such as component increase, cost increase.

SUMMARY OF THE INVENTION

Accordingly, it is a primary object of the present invention to provide an improved vane pump wherein the amplitude of pressure pulsation of discharged fluid can be reduced to a required level, thereby eliminating vibrations and noises generated by the pump and connection pipes connected thereto.

Another object of the present invention is to provide an improved vane pump of the character set forth above wherein the pressure pulsation of the discharged fluid can be reduced without any additional component such as an accumulator.

Briefly, according to the present invention, there is provided a vane pump comprising a cam ring received in a pump housing assembly, a rotor disposed within the cam ring, and plural vanes supported by the rotor and being contacted with an internal cam surface of the cam ring. The both side edges of each vane contact with a pair of flat contact surfaces formed within the pump housing assembly so as to define plural pump sectors, together with the cam ring and the rotor. At least one of the flat contact surfaces is formed with an intake port for leading fluid into the pump sectors, and an exhaust port for discharging fluid pressurized in the pump sectors Furthermore, a pressure leaking groove is formed at one of the flat contact surfaces so as to partially leak fluid within a pump sector communicating with the exhaust port to an adjacent pump sector communicating with the intake port through a passage formed by the pressure leaking groove and one of the side edges of a vane located between the pump sectors, whenever the instantaneous pressure in the exhaust port reaches its instantaneous maximum pressure.

With this configuration, pressurized fluid in the pump sector communicating with the exhaust port is partially discharged to the intake port whenever the pressure in the exhaust port reaches to the instantaneous maximum pressure, whereby the amplitude of pressure pulsation of fluid discharged from the exhaust port is reduced without any additional component.

BRIEF DESCRIPTION OF THE ACCOMPANYING DRAWINGS

The foregoing and other object and many of the attendant advantages of the present invention will be readily appreciated as the same becomes better understood by reference to the following detailed description preferred embodiments when considered in connection with the accompanying drawings, wherein like reference numerals designate identical parts throughout the several views, and in which:

FIG. 2(*b*) is a sectional view of the vane pump taken along the line II—II in FIG. 1 showing a modification of the first embodiment;

Figure 1:
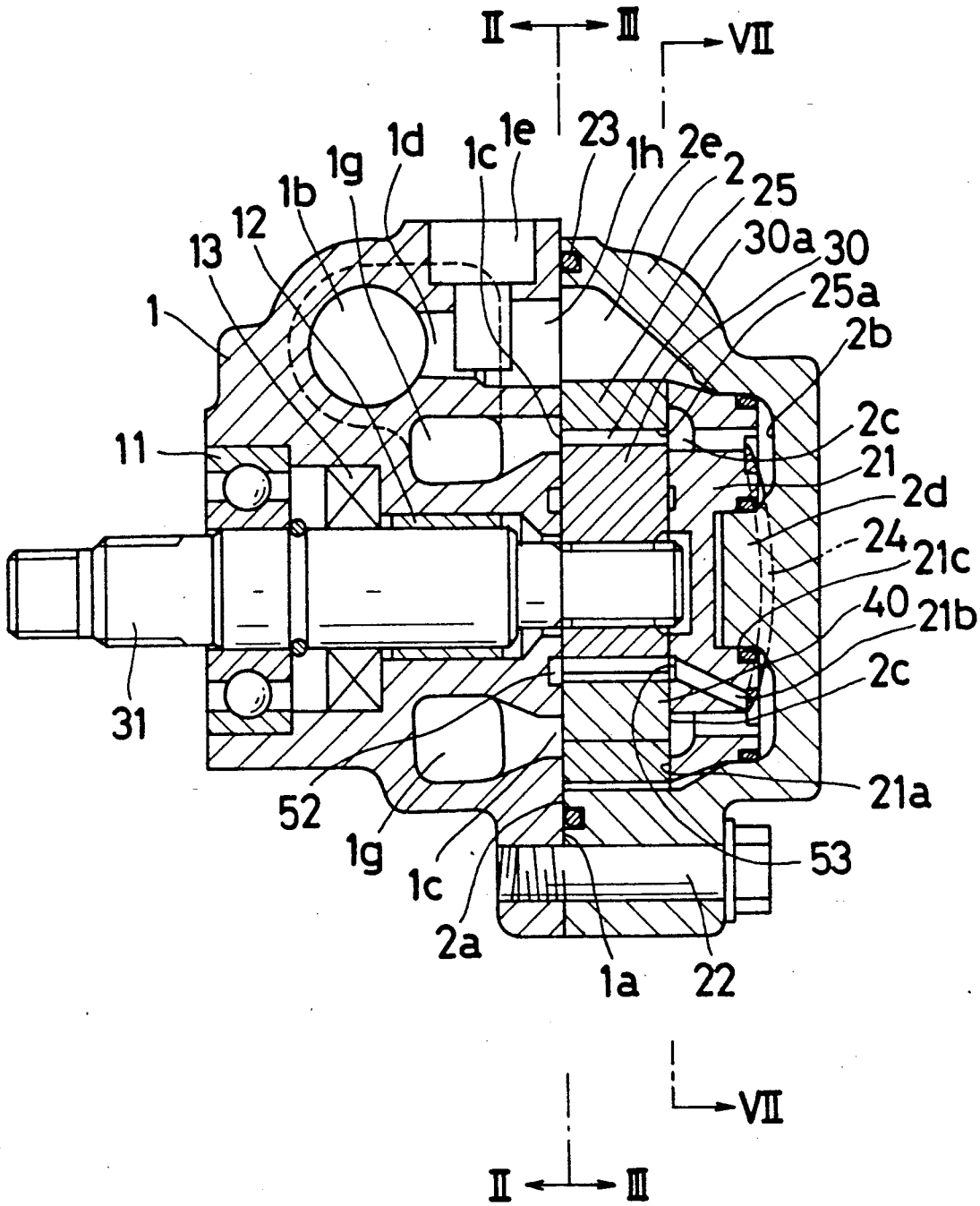
FIG. 1 is a sectional vie of a vane pump according to the first embodiment of the present invention.
Figure 3:
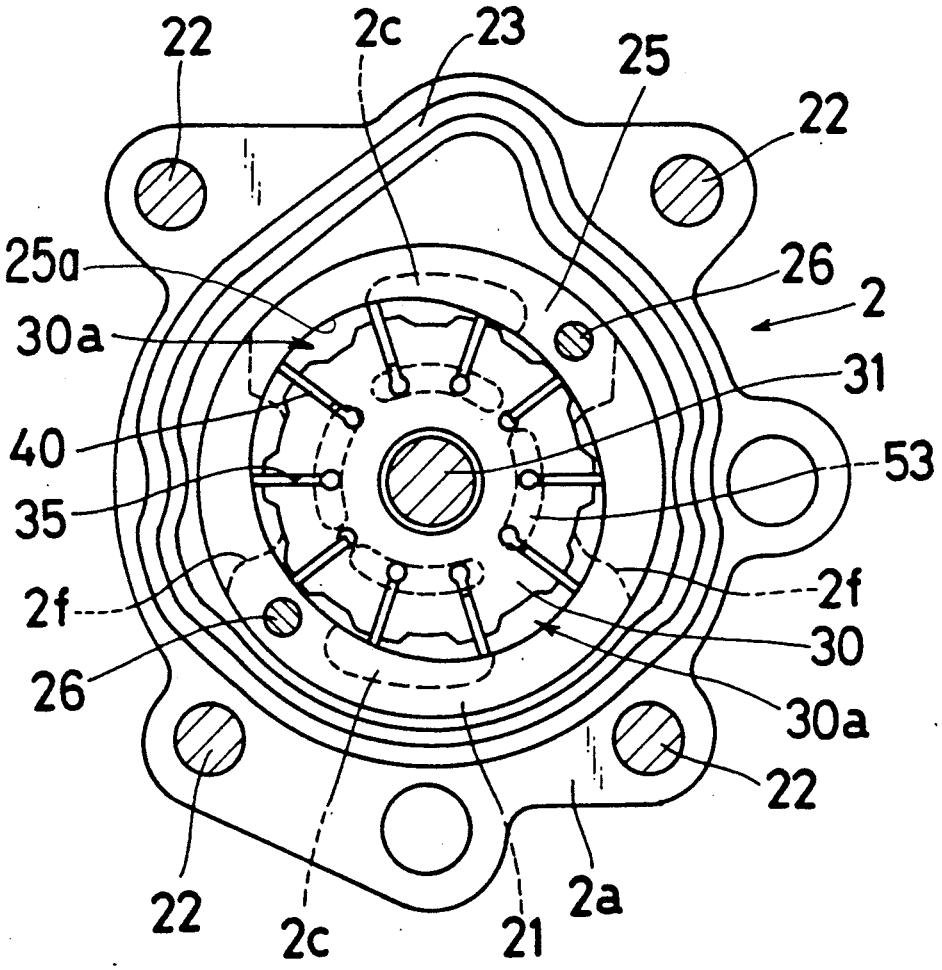
Figure 4:
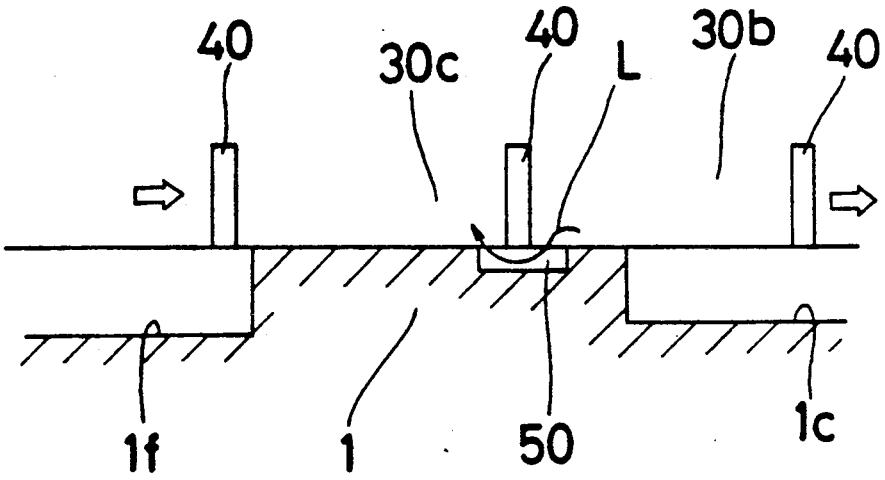
Figure 5:
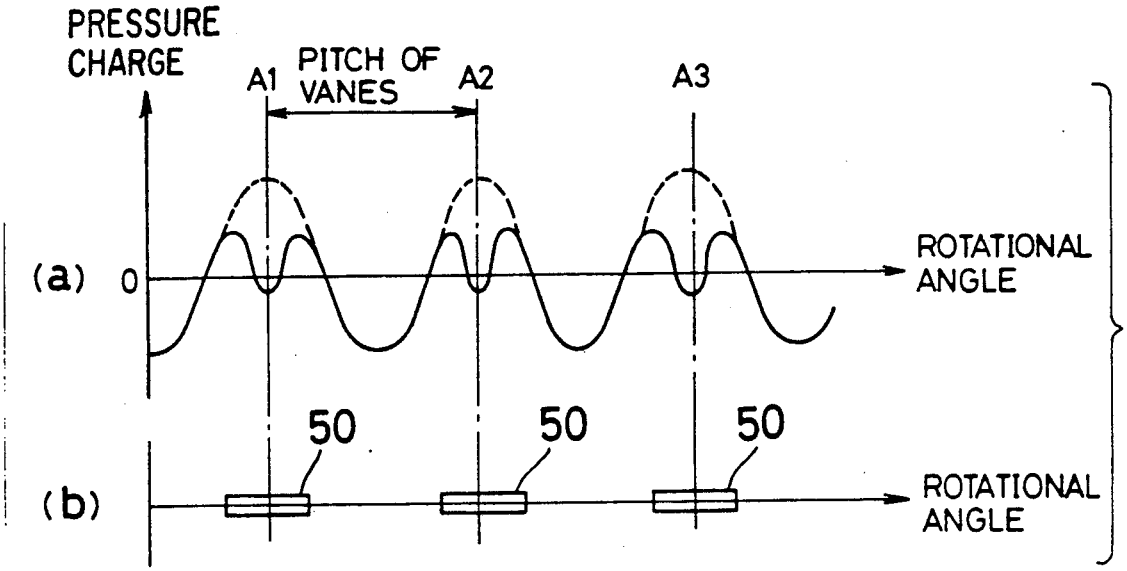
Figure 6:
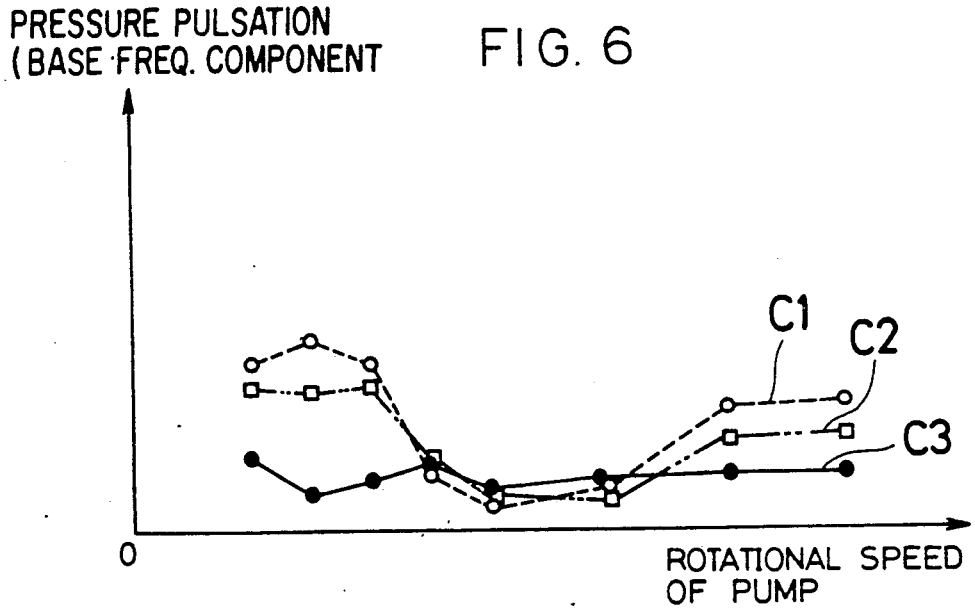
Figure 7:
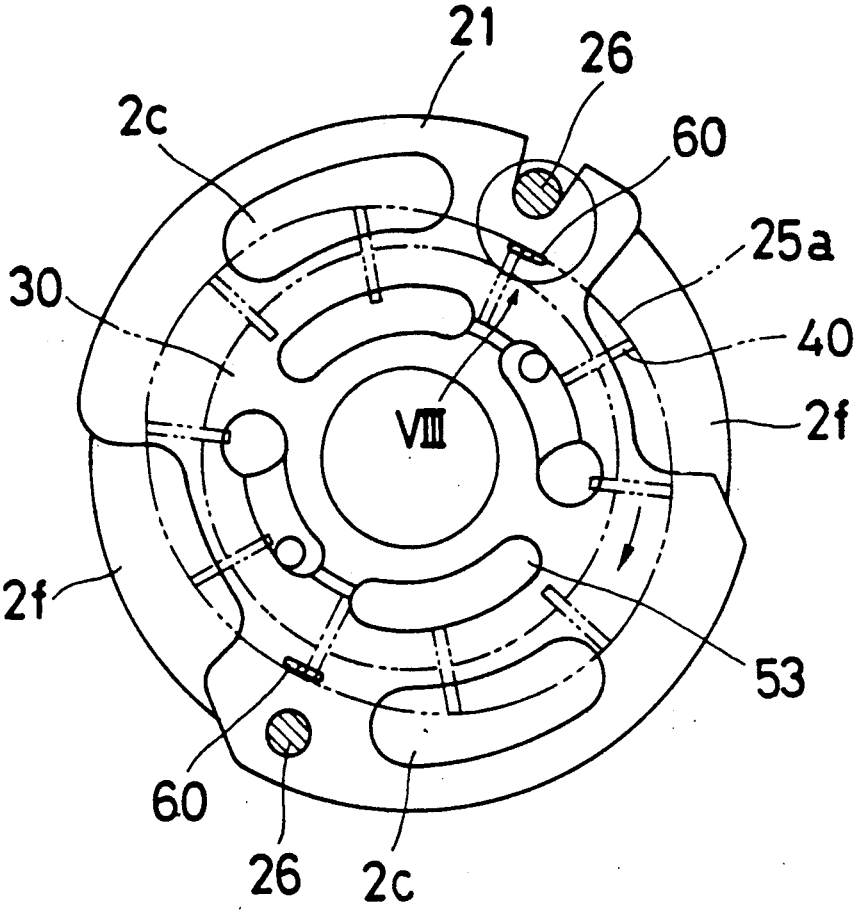
Figure 8:
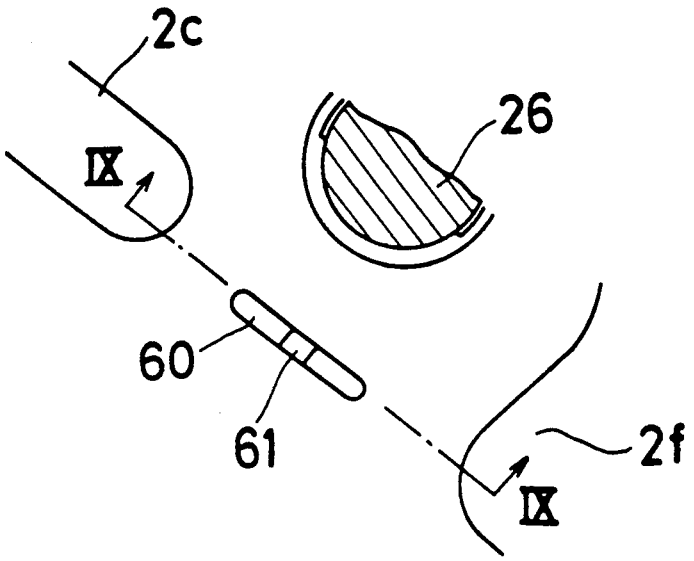
Figure 9:
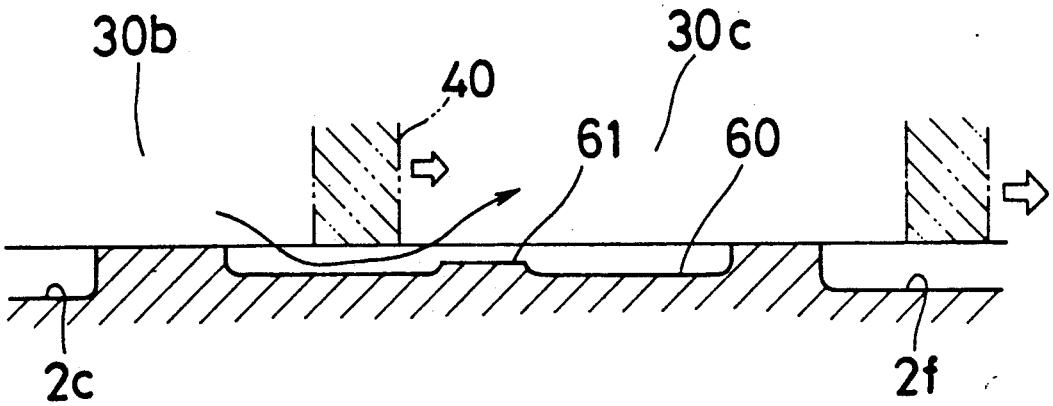
Figure 13:
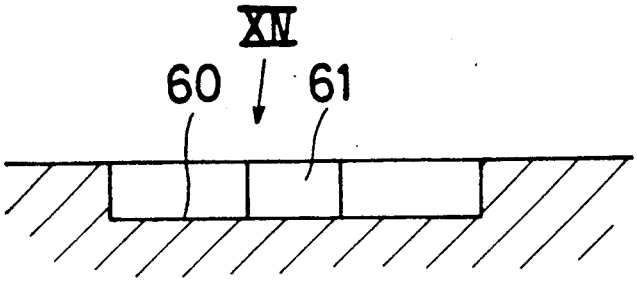
Figure 14:
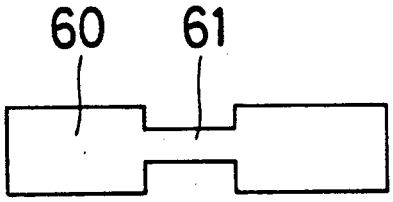
Figure 15:
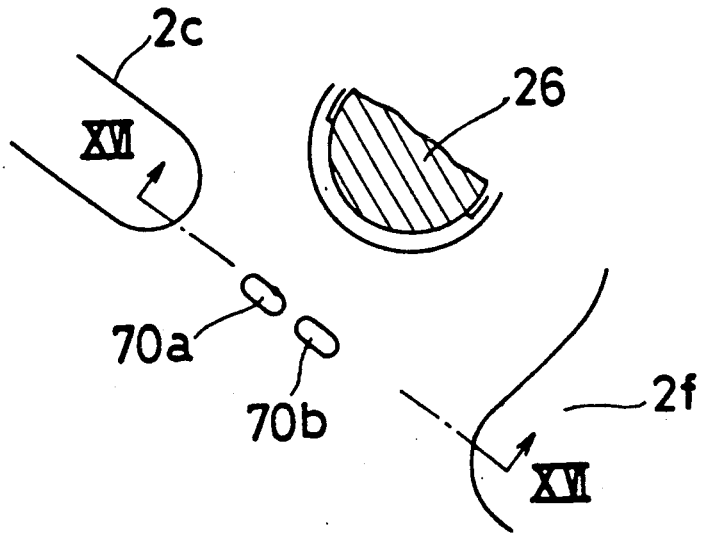
Figure 16:
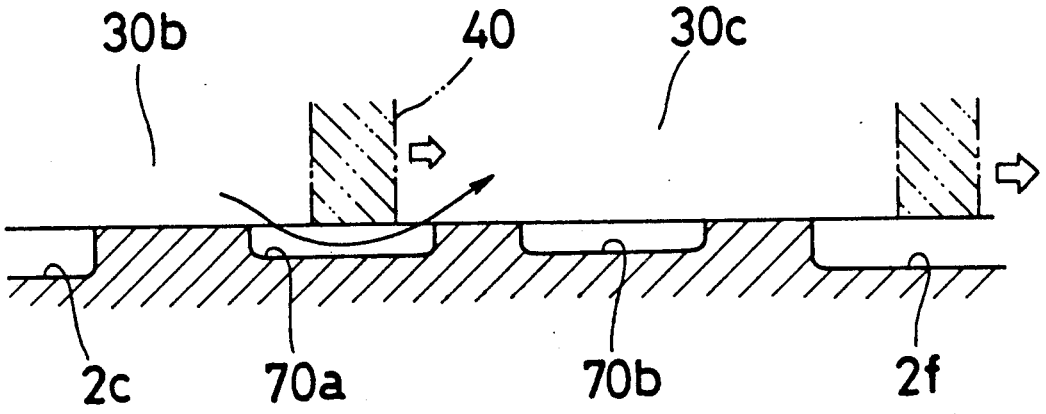
Figure 17:
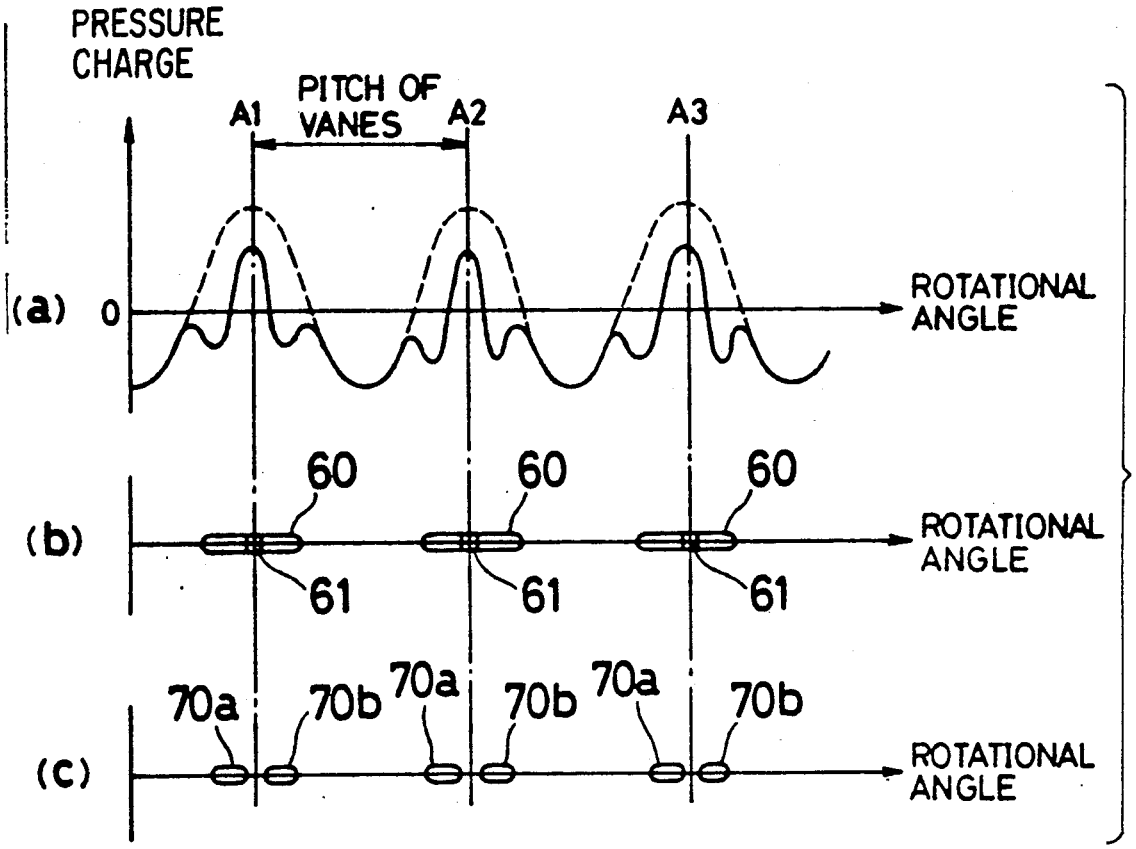
Figure 18A:
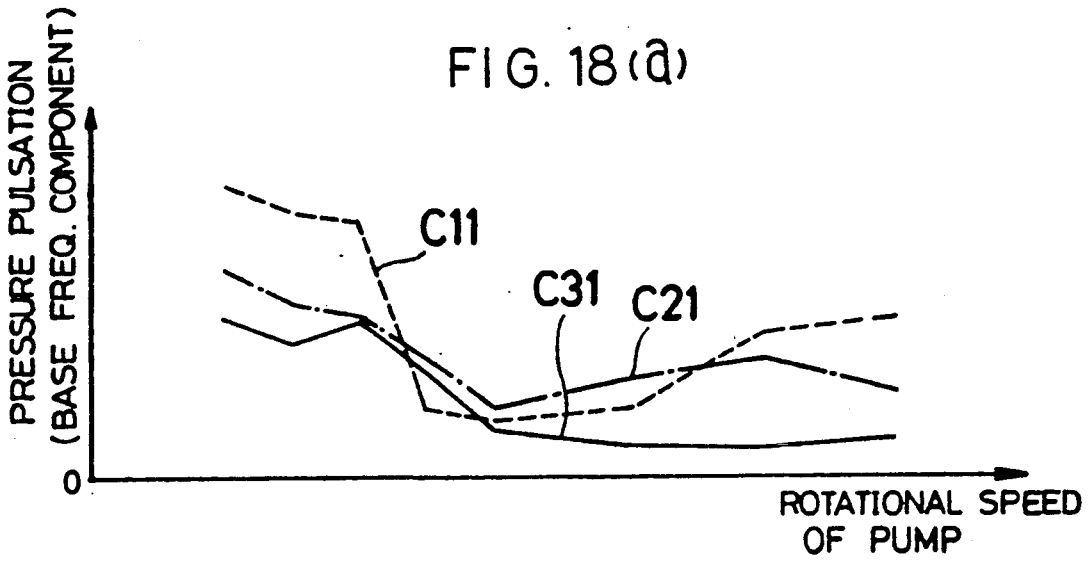
Figure 18B:
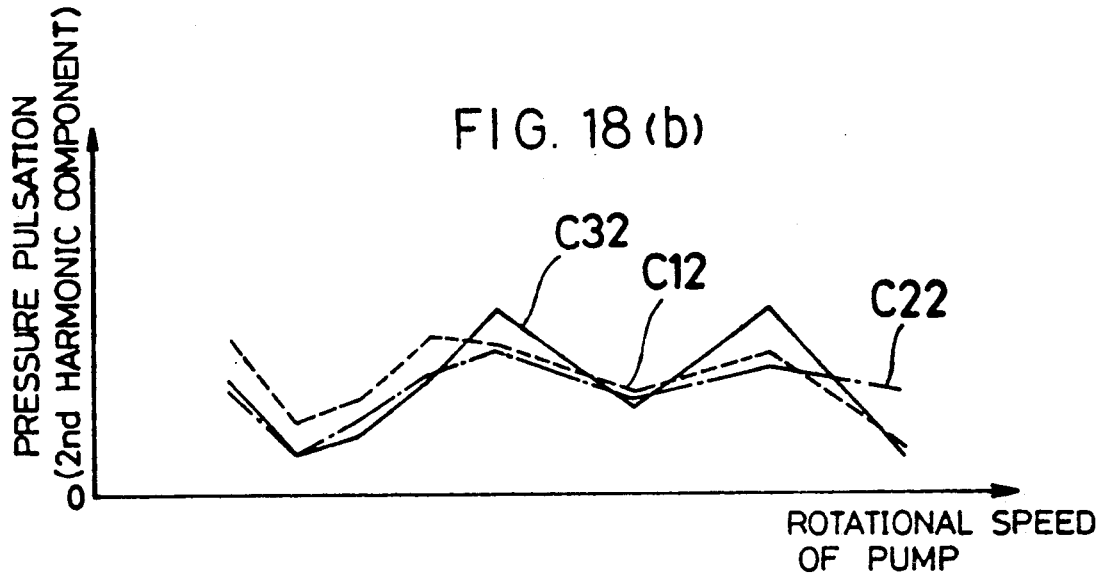
Figure 18C:
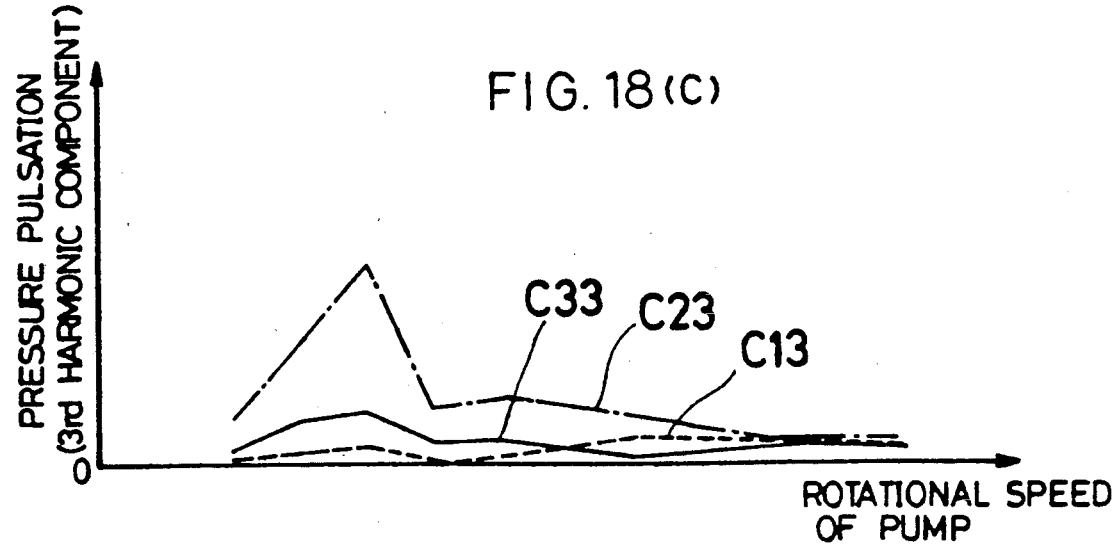

FIG. 3 si a sectional view of the vane pump taken along the line III—III in FIG. 1;

FIG. 4 is an expansion plan showing the configuration of pressure leaking grooves formed at a contact surface of the pump housing;

FIG. 5(*a*) and FIG. 5(*b*) are charts showing the change of fluid pressure in exhaust ports and the positions of the pressure leaking grooves in the pump according to the first embodiment;

FIG. 6 is a graph showing the change of the amplitude of the pressure pulsation of fluid discharged from the exhaust port with respect to the change of the rotational speed of the pump;

FIG. 7 is a sectional view of the vane pump taken along the line VII—VII in FIG. 1 showing pressure leaking grooves according to the second embodiment of the present invention;

FIG. 8 is an enlarged segmentary view of one of the pressure leaking grooves encircles by a circle VIII in FIG. 7;

FIG. 9 is a sectional view taken along the line IX—IX in FIG. 8;

FIG. 10 through FIG. 13 are sectional views showing modified pressure leaking grooves;

FIG. 14 is a view seen from a direction XIV in FIG. 13;

FIG. 15 is an enlarged segmentary view of a pressure leaking groove showing the third embodiment of the present invention;

FIG. 16 is a sectional view taken along the line XVI-XVI in FIG. 15;

FIG. 17(*a*) through FIG.(*c*) are charts showing the change of fluid pressure in the exhaust ports and the positions of pressure leaking grooves in the pump according to the second and third embodiments; and FIG. 18(*a*) through FIG. 18(*c*) are graphs showing the change of the amplitude of the base frequency components, the second harmonic components and the third harmonic components of pressure pulsations of the fluid discharged from the exhaust port with respect to the change of the rotational speed of the pump.

DETAILED DESCRIPTION OF THE PREFERRED EMBODIMENTS

Referring now to the drawing and more particularly to FIG. 1 thereof, a vane pump according to the first embodiment of the present invention is shown having a first pump housing 1 supporting a drive shaft 31, and a second pump housing 2 receiving a side plate 21 therein. The first pump housing 1 and the second pump housing 2 are assembled such that a flat contact surface 1*a* of the first pump housing 1 and a flat contact surface 2*a* of the second pump housing 2 contact each other, and are fixed to each other with plural bolts 22. A reference numeral 23 indicates a seal ring disposed between the first and second contact surfaces 1*a* and 2*a*. The first pump housing 1, the second pump housing 2 and the side plate 21 compose a pump housing assembly.

The drive shaft 31 is supported within the first pump housing 1 through a ball bearing 11 and a bearing sleeve 12. A reference numeral 13 indicates a seal disposed between the ball bearing 11 and the bearing sleeve 12.

A chamber defined by the first pump housing 1, the second pump housing 2 and the side plate 21 contains therein a cam ring 25 whose one end surface contacts with the contact surface 1*a* of the first pump housing 1 and the other end surface contacts with a flat contact surface 21*a* of the side plate 21. The side plate 21 is formed at its center portion with a cylindrical bore 21*c* engaging with a cylindrical projecting portion 2*d* of the second pump housing 2. A washer spring 24 is compressedly interposed between the side plate 21 and the second pump housing 2 such that the force of the washer spring 24 brings the side plate 21, the cam ring 25 and the first pump housing 1 into contact engagement. A pair of locating pins 26 extend between the first pump housing 1 and the side plate 21 to hold the cam ring 25 and the side plate 21 against rotation, as shown in FIG. 2(*a*) and FIG. 3.

The cam ring 25 is formed with an internal cam surface 25*a* which is approximately oval. A rotor 30 is disposed within the cam ring 25 and is in spline connection with the inner end of the drive shaft 31. The rotor 30 is formed with ten of equiangularly spaced vane supporting slots 35 extending in radial directions, and vanes 40 are received within the vane supporting slots 35 to be movable in the radial directions, as shown in FIG. 3. The axial width of the rotor 30 and the vanes 40 is chosen to be slightly less than that of the cam ring 25, and the outer edges of the vanes 40 contact with the internal cam surface 25*a* of the cam ring 25. With this configuration, plural pump sectors 30*a* whose volume change in accordance with the curve of the cam surface 25*a* are defined between the rotor 30 and the cam ring 25.

Figure 2A:
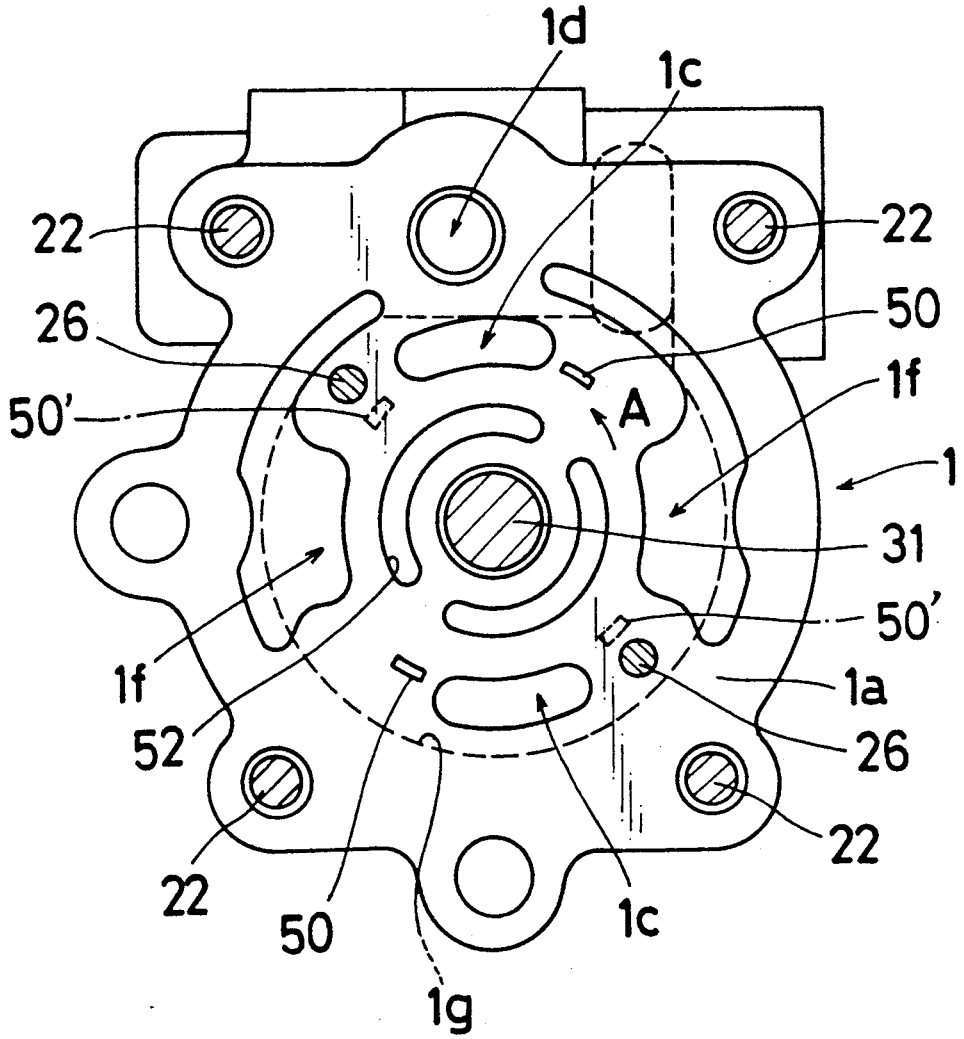
FIG. 2(*a*) is a sectional view of the vane pump taken along the line II—II in FIG. 1.
Figure 2B:
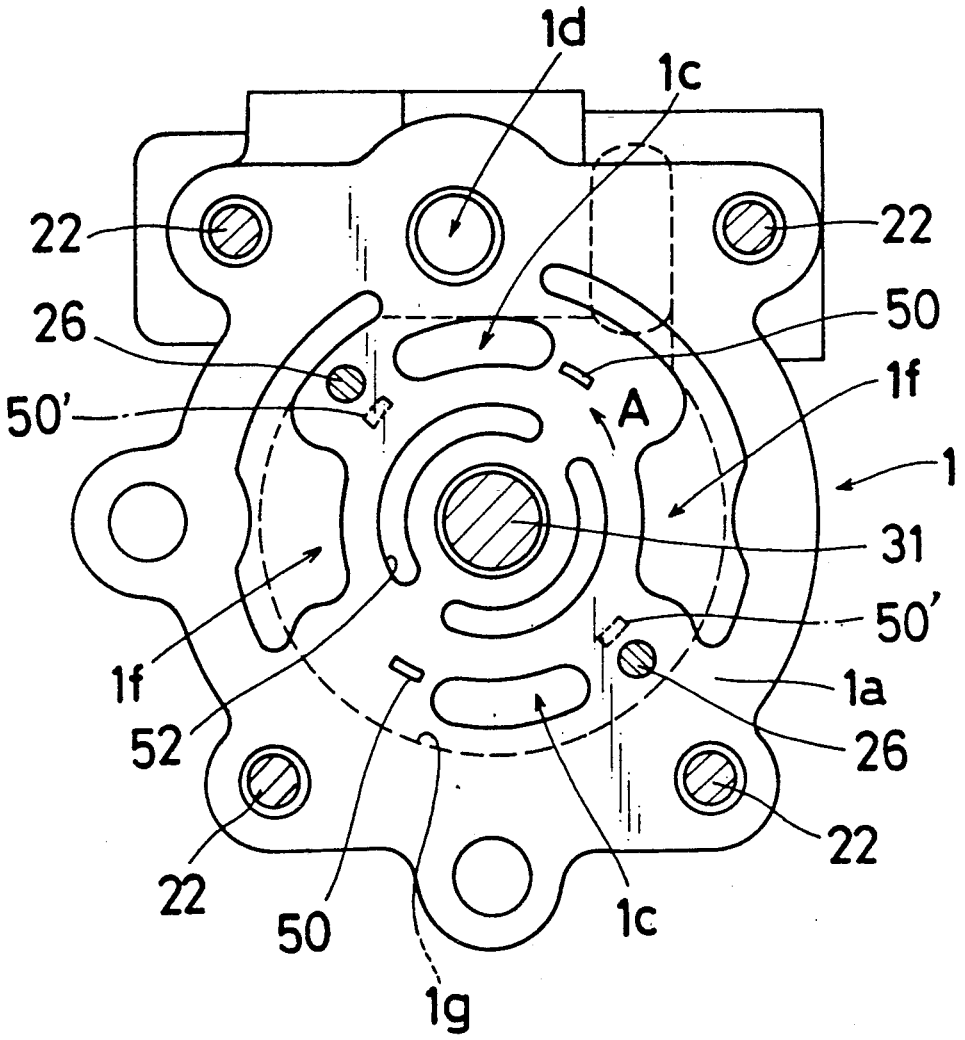

The first pump housing 1 is formed at its contact surface 1*a* with a pair of exhaust ports 1*c* and a pair of intake ports 1*f*, as shown in FIG. 2. These intake ports 1*f* and exhaust ports 1*c* are formed alternately in the rotational direction of the rotor 30. The pair of intake ports 1*f* communicate with a supply chamber 2*e* formed between the peripheral surface of the cam ring 25 and the second pump housing 2. The supply chamber 2*e* communicates with a suction passage 1*h* leading to a reservoir port 1*e* and a bypass passage 1*d*. The bypass passage 1*d* communicates with a valve bore 1*b*, in which a flow control valve (not shown) is disposed. The exhaust ports 1*c* communicate with a discharge chamber 1*g*, which is formed so as to surround the drive shaft 31. The discharge chamber 1*g* communicates with a fluid delivery port (not shown) through a throttle passage (not shown) and further communicates with the above-noted bypass passage 1*d* via the valve bore 1*b*.

The side plate 21 is also formed with a pair of intake ports 2*f* and a pair of exhaust ports 2*c* at the same angle positions as those of the intake ports 1*f* and the exhaust ports 1*c*, respectively. Furthermore, a pressure chamber 2*b* communicating with the exhaust ports 2*c* is formed between the side plate 21 and the second pump housing 2. A reference numeral 52 indicates back-up pressure grooves formed at the contact surface 1*a* of the first pump housing 1 so as to communicate with inner parts of the vane supporting slots 35 and a reference numeral 53 indicates back-up pressure grooves formed at the contact surface 21*a* of the side plate 21 so as to communicate with the inner parts of the vane supporting slots 35. The back-up grooves 53 communicate with the pressure chamber 2*b* via a passage 21*b* formed in the side plate 21. With this configuration, pressurized fluid is supplied from the pressure chamber 2*b* to the inner parts of the vane supporting slots 35 through the back-up pressure grooves 52 and 53 and the passage 21*b* so that the vanes 40 are forced to move toward the internal cam surface 25*a* of the cam ring 25.

Furthermore, the contact surface 1*a* of the first pump housing 1 is formed between intake ports 1*f* and exhaust ports 1*c* with a pair of pressure leaking grooves 50, as shown in FIG. 2. The locations of the pressure leaking grooves 50 are chosen so as to leak pressurized fluid in a pump sector 30*b* communicating with the exhaust ports 1*c* and 2*c* to an adjacent pump sector 30*c* communicating with the intake ports 1*f* through a passage formed by a side edge of a vane 40 located between the pump sectors 30*b* and 30*c* and the pressure leaking grooves 50, as indicated by an arrow L in FIG. 4, whenever the rotational angle of the rotor 30 reaches one of rotational angle positions Al, A2, A3. . . whereat the instantaneous fluid pressure in the exhaust ports 1*c* and 2*c* reach the instantaneous maximum value, as shown in FIG. 5(*a*) and FIG. 5(*b*). The width, depth and length of the pressure leaking grooves are chosen such that the instantaneous maximum pressure is reduced to a predetermined value, thereby the amplitude of the pressure pulsation being reduced to a required value.

The vane pump according to the present invention is constructed as described above, and when the rotor 30 is rotated bodily with the drive shaft 31, operating fluid is sucked from the supply chamber 1*h* into the pump sectors 30*a* via the intake ports 1*f* and 2*f*. Rotation of the rotor 30 further causes pressurized fluid to be discharged from the pump sectors 30*a* into the discharge chamber 1*b* via the exhaust ports 1*c* and 2*c*, and the pressurized fluid is then delivered to, for example, a power steering apparatus (not shown) through the fluid delivery port.

When the rotor 30 reaches one of the rotational angles, two vanes 40 move to locations corresponding to the pressure leaking grooves 50 as shown in FIG. 4, thereby the fluid in the pump sectors 30*b* communicating with the exhaust ports 1*c* and 2*c* leaking to the pump sectors 30*c* communicating with the intake ports 1*f* and 2*f* through passages formed by the side edges of the vanes 40 and the pressure leaking grooves 50. As a result, the instantaneous pressure of the fluid in the exhaust ports 1*c* and 2*c* changes as indicated by a solid line in FIG. 5 (*a*), thereby the amplitude of the pressure pulsation being reduced as compared with the amplitude of pressure pulsation of fluid discharged from a prior type of vane pump which is not provided with any pressure leaking groove. A chain line C2 in FIG. 6 indicates the change of the amplitude of the base frequency component of the fluid discharged from the exhaust ports 1c and 2c with respect to the change of the rotational speed of the pump. Since the base frequency component is a major component of the pressure pulsation, the amplitude of the pressure pulsation is in proportion to the amplitude of the base frequency component. As shown in FIG. 6, the amplitude of the base component of the pressure pulsation is smaller than that of the fluid discharged from the prior type of vane pum which is indicated by a dotted line Cl in FIG. 6. Accordingly, the amplitude of the pressure pulsation becomes smaller as compared with the prior type of vane pump.

Although the pressure leaking grooves 50 are formed at angular locations just before the exhaust ports 1c and 2c in the rotational direction of the rotor 30, in the above described first embodiment, the pressure leaking grooves can be formed just after the exhaust ports as indicated by a reference numeral 50' in FIG. 2(*b*). Furthermore, the pressure leaking grooves can be formed at the contact surface 21*a* of the side plate 21. The solid line C3 in FIG. 6 indicate the amplitude of the base frequency component of pressure pulsation of the fluid discharged from a vane pump wherein pressure leaking grooves 50' are formed at the contact surface 21*a* of the side plate 21 at locations after the exhaust ports 1c and 2c in the rotational direction. As shown in FIG. 6, the amplitude of the base frequency component is more effectively reduced, thereby the amplitude of the pressure pulsation being also reduced.

The vane pump according to the first embodiment and the modifications thereof described above can effectively reduce the base frequency component and the second harmonic component of the pressure pulsation, as indicated by chain lines C21 and C22 in FIG. 18(*a*) and FIG. 18(*b*), as compared with that in the prior type of vane pump which is indicated by a dotted lines C11 and C12. The third harmonic component of the pressure pulsation, however, increase as shown by a change line C23 in FIG. 18(*c*), as compared with that in the prior type of vane pump which is indicated by a dotted line C13.

The second embodiment capable of reducing the amplitude of the third harmonic component as well as the base frequency component and the second harmonic component, will be explained hereinafter with reference to FIGS. 7 through 9.

In the second embodiment, pressure leaking grooves 60 are formed at the contact surface 21*a* of the side plate 21 at locations after the exhaust ports 1c and 2c in the rotational direction of the rotor 30. Each pressure leaking groove 60 is formed to have a predetermined constant width and length, but the depth becomes smaller at its center portion 61 as shown in FIG. 9. The locations of the pressure leaking grooves 60 are chosen such that the vanes 40 between the exhaust ports 1c and 2c and the intake ports 1*f* and 2*f* move to angle locations corresponding to the center portions 61 of the pressure leaking grooves 60 when the rotational angle of the rotor 30 reaches one of angles whereat the instantaneous pressure of the fluid in the exhaust ports 1c and 2c reaches the maximum pressure, as shown in FIG. 17(*a*) and FIG. 17(*b*).

With this configuration, the fluid in the pump sectors 30*b* communicating with the exhaust ports 1c and 2c start to leak to the pump sectors 30*c* communicating with the intake ports 1*f* and 2*f* through passages formed by the grooves 60 and side edges of the vanes 40, as shown in FIG. 9, before the instantaneous pressure of the fluid reaches the maximum pressure. Thereafter, the amount of leaking fluid is reduced when the rotor 30 reaches one of rotational angle positions, whereat the fluid pressure in the exhaust ports 1c and 2c reaches to the maximum pressure. Namely, the vanes 40 between the pump sectors 30*b* and the pump sectors 30*c* move to locations corresponding to the locations of the center portions 61 of the pressure leaking grooves 60, thereby the leakage amount of the pressurized fluid being reduced. The amount of the leaking fluid again increases when the vanes 40 have passed through locations corresponding to the center portions 61 of the pressure leaking grooves 60. With this operation, the pressure of the fluid in the exhaust ports 1c and 2c changes as indicated by a solid line in FIG. 17(*a*). As a result, both the base frequency component and the third harmonic component, whose amplitudes are indicated by a solid lines C31 and C33 in FIG. 18(*a*) and FIG. 18(*c*), respectively, are reduced as compared with a pump constructed according to the first embodiment. Although the amplitude of the second harmonic component slightly increases as indicated by a solid line C32 in FIG. 18(*b*), the increase amount is smaller than the decrease amount of the third harmonic component. Therefore, the amplitudes of the pressure pulsation can be reduced more effectively.

Figure 10:
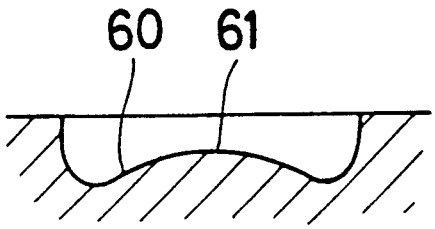
Figure 11:
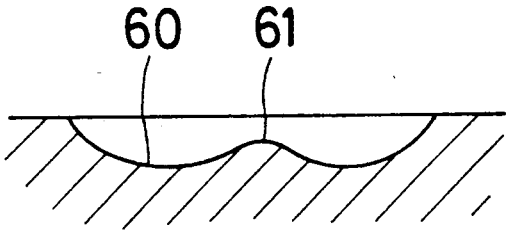
Figure 12:
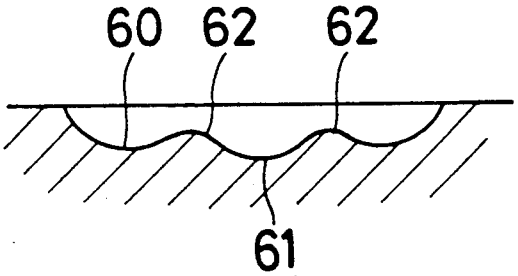

The shape of the pressure leaking grooves 60 can be modified to other shapes shown in FIG. 10 through FIG. 12. The grooves 60 shown in FIG. 10 and FIG. 11 are formed such that the depth of each groove changes continuously and becomes smallest at its center portion 61. The groove shown in FIG. 12 has a shape wherein the depth becomes smaller at two positions 62 located at opposite sides with respect to the center portion 61 of the grooves 60.

Furthermore, the shape of the pressure leaking grooves 60 can be modified as shown in FIGS. 13 and 14. The pressure leaking groove 60 shown In FIG. 13 has a constant depth, but the width of the groove 60 is narrowed at its center portion 61, as shown in FIG. 14.

The vane pump according to the second embodiment of the present invention and the modifications thereof described above tend to be affected by the machining accuracy of the grooves 60, because the depth at their center portions 61 slightly change due to the machining errors. If the depth at the center portion 61 changes, the leakage amount of the pressurized fluid changes, thereby the amplitude of the pressure pulsation being also changed in proportion thereto.

The vane pump according to the third embodiment capable of eliminating such disadvantage will be now explained. FIG. 15 and FIG. 16 show the third embodiment of the present invention wherein two pair of the grooves 70*a* and 70*b* are formed on the side plate 21. Each pair of the grooves 70*a* and 70*b* are formed between the exhaust ports 2c and the intake ports 2*f*. Each pair of grooves 70*a* and 70*c* are located before and after the rotational angle positions A1, A2 . . ., as shown in FIG. 17(*a*) and FIG. 17(*c*), whereat the pressure of the fluid in the exhaust ports 1c and 2c reaches the maximum pressure.

With this configuration, the fluid in the pump sectors 30*b* communicating with the exhaust ports 1*c* and 2*c* starts to leak to the pump sectors 30*c* communicating with the intake ports 1*f* and 2*f* through passages formed by the pressure leaking grooves 70*a* and the side edges of the vanes 40, before the instantaneous pressure of the fluid reaches the maximum value, and the leakage of the fluid is then stopped when the rotor 30 reaches one of the rotational angle positions. Because the vanes 40 between the pump sectors 30*b* and the pump sectors 30*c* move to locations between the pair of grooves 70*a* and 70*b*. Thereafter, the fluid again starts to leak through passages formed by grooves 70*b* and the side edges of the vanes 40. By this operation, the instantaneous maximum pressure of the fluid in the exhaust ports 1*c* and 2*c* are decreased, but the amount of the fluid leakage hardly changes regardless of the machining errors of the grooves 70*a* and 70*b*.

Although pressure leaking grooves are formed only at one of the contact surface 21 of the side plate 21 and the contact surface 1*a* of the first pump housing 1, in the first through third embodiments, the grooves can be formed at both of them. Moreover, the number and the size of the grooves, and the locations thereof can be modified in accordance with the amplitude of pressure pulsation and the pressure curve of the fluid discharged from the exhaust ports.

Obviously, numerous modifications and variations are possible in light of the above teachings. It is therefore to be understood that within the scope of the appended claims, the present invention may be practiced otherwise than as specifically described herein.

What is claimed is:

1. A vane pump for pumping fluid, comprising;

a pump housing assembly;

a cam ring received within said pump housing assembly and formed with an internal cam surface therein, each end surface of said cam ring respectively contacting with a pair of flat surfaces formed within said pump housing assembly;

a rotor disposed within said cam ring and formed with equiangularly spaced plural vane supporting slots;

a drive shaft rottabnly disposed within said pump housing assembly for rotating said rotor;

a plurality of vanes respectively disposed within said vane supporting slots of said rotor, said vanes being radially extensible from said rotor for moving along said internal cam surface when said rotor is rotated, said vanes defining plural pump sectors between said cam ring and said rotor, together with said cam ring, said rotor, and said pair of flat surfaces of said pump housing assembly;

an intake port formed at one of said flat surfaces of said pump housing assembly for leading fluid into said pump sections at a predetermined location;

an exhaust port formed at one of said flat surfaces of said pump housing assembly for taking out fluid pressurized in said sectors at a location difference from that of said intake port;

at least one pressure leaking groove formed at at least one of said flat surfaces at a location between said intake port and aid exhaust port, the location of said pressure leaking groove being chosen so as to form a passage together with a side edge of one of said vanes located between said exhaust port and said intake party, and the length of said pressure leaking groove being chosen not to reach said exhaust sort or said intake port, so that fluid in a pump sector communicating with said exhaust port starts leaking to an adjacent pump sector communicating with said intake port through said passage, whenever the rotational angle of said rotor approaches to one of rotational angles whereat the instantaneous pressure of fluid in said exhaust port is to reach a maximum pressure, and stops leaking before said one of said vanes reaches said exhaust port or intake port.

2. A vane pump as set forth in claim 1, wherein:

said pump housing assembly is composed of a first pump housing being formed with one of said flat surfaces, a second pump housing having a bore in which said cam ring is disposed, and a side plate disposed within said bore of said second housing and being formed with the other of said flat surfaces.

3. A vane pump as set forth in claim 2, wherein:

said pressure leaking groove is composed of single groove having a predetermined length in the rotational direction of said rotor and a predetermined constant cross section, and wherein the location of said pressure leaking groove is chosen such that one of said vanes moves to a location corresponding to the enter of said pressure leaking groove whenever the rotation angle of said rotor reaches one of predetermined angle positions whereat the instantaneous pressure of fluid in said s exhaust port is to reach a maximum pressure.

4. A vane pump as set forth in claim 2, wherein:

said pressure leaking groove is composed of single groove having a cross section which become smaller at its center portion in the rotational direction than that of remaining portion thereof, and wherein the location of said pressure leaking groove is chosen such that one of said vanes moves to a location corresponding o the center portion of said pressure leaking groove whenever the rotational angle of said rotor reaches one of predetermined angle positions whereat the instantaneous pressure of fluid in said exhaust port is to reach a maximum value.

5. A vane pump as set forth in claim 2, wherein:

said pressure leaking groove is composed of a pair of grooves being respectively located at opposite sides with respect to an angle location whereto one of said vanes is moved whenever the rotational angle of said rotor reaches one of predetermined angle positions whereat the instantaneous pressure of fluid in said exhaust port is to reach a maximum pressure.

6. A vane pump for pumping fluid, comprising;

a cam ring having an internal cam surface therein;

a pair of members each dispose at opposite sides of said cam ring in contact relationship with said claim ring, each end surface of said cam ring respectively contacting with salt surfaces formed on said pair of members assembly;

a rotor disposed within said cam ring and formed with equiangularly spaced plural vane supporting slots;

a drive shaft for rotating said rotor;

a plurality of vanes respectively disposed within said vane supporting slots of said rotor, said vanes being radially extensible from said rotor for moving along said internal cam surface when said rotor is rotated, said vanes defining plurality pump sectors between said cam ring and sad rotor, together with said cam ring, said rotor, and said pair of flat surfaces;

an intake port formed in one of said members for leading fluid in to said pump sectors at a predetermine location;

an exhaust port formed in one of said members for taking out fluid pressurized in said sectors at a location difference from that of said intake port;

at least one pressure leaking groove formed at at least one of said flat surfaces at a location between said intake port and said exhaust port, the location of said pressure leaking groove being chosen so as to form a passage together with a side edge of one of said vanes located between said exhaust port and aid intake port, and the length of said pressure leaking groove being chosen not to reach said exhaust port or said intake port, so that fluid in a pump sector communicating with said exhaust port starts leaking to an adjacent pump sector communicating with said intake port through said passage, whenever the rotational angle of said rotor approaches to one of rotational angles whereat the instantaneous pressure of fluid in said exhaust port is to reach a maximum pressure, and stops leaking before said one of said vanes reaches said exhaust port or intake port.

* * * * *